United States Patent [19]

Steele

[11] 3,955,644

[45] May 11, 1976

[54] SCAFFOLDING CONSTRUCTIONS

[75] Inventor: Raymond Ernest Steele, Kenilworth, England

[73] Assignee: Kwikform Limited, Birmingham, England

[22] Filed: July 14, 1975

[21] Appl. No.: 595,540

[30] Foreign Application Priority Data

July 19, 1974 United Kingdom ..... 32014/74

[52] U.S. Cl. ..... 182/82; 182/178; 52/637

[51] Int. Cl.[2] ..... E04G 1/06

[58] Field of Search ..... 182/82, 178, 179, 150, 182/128, 132, 130; 52/637, 638, 639, 641, 653

[56] References Cited

UNITED STATES PATENTS

| | | | |
|---|---|---|---|
| 1,506,114 | 8/1924 | Donaggio | 182/150 |
| 1,950,167 | 3/1934 | Epps | 182/150 |
| 3,807,529 | 4/1974 | Reed | 182/130 |
| 3,870,124 | 3/1975 | Howard | 182/178 |

FOREIGN PATENTS OR APPLICATIONS

| | | | |
|---|---|---|---|
| 841,372 | 2/1939 | France | 182/130 |
| 1,276,293 | 6/1972 | United Kingdom | 182/178 |
| 102,148 | 7/1965 | Denmark | 182/179 |

*Primary Examiner*—Reinaldo P. Machado
*Attorney, Agent, or Firm*—Parmelee, Miller, Welsh & Kratz

[57] ABSTRACT

To enable a scaffolding structure to serve vertically curved structures such as ships' hulls, a joint is provided to allow vertically adjacent scaffold uprights to be relatively inclined to one another in a vertical plane. Transom elements and staging brackets are provided with pivotally mounted means for connection to the inclined uprights so as to enable staging to be carried substantially horizontally.

14 Claims, 10 Drawing Figures

Figure 1:
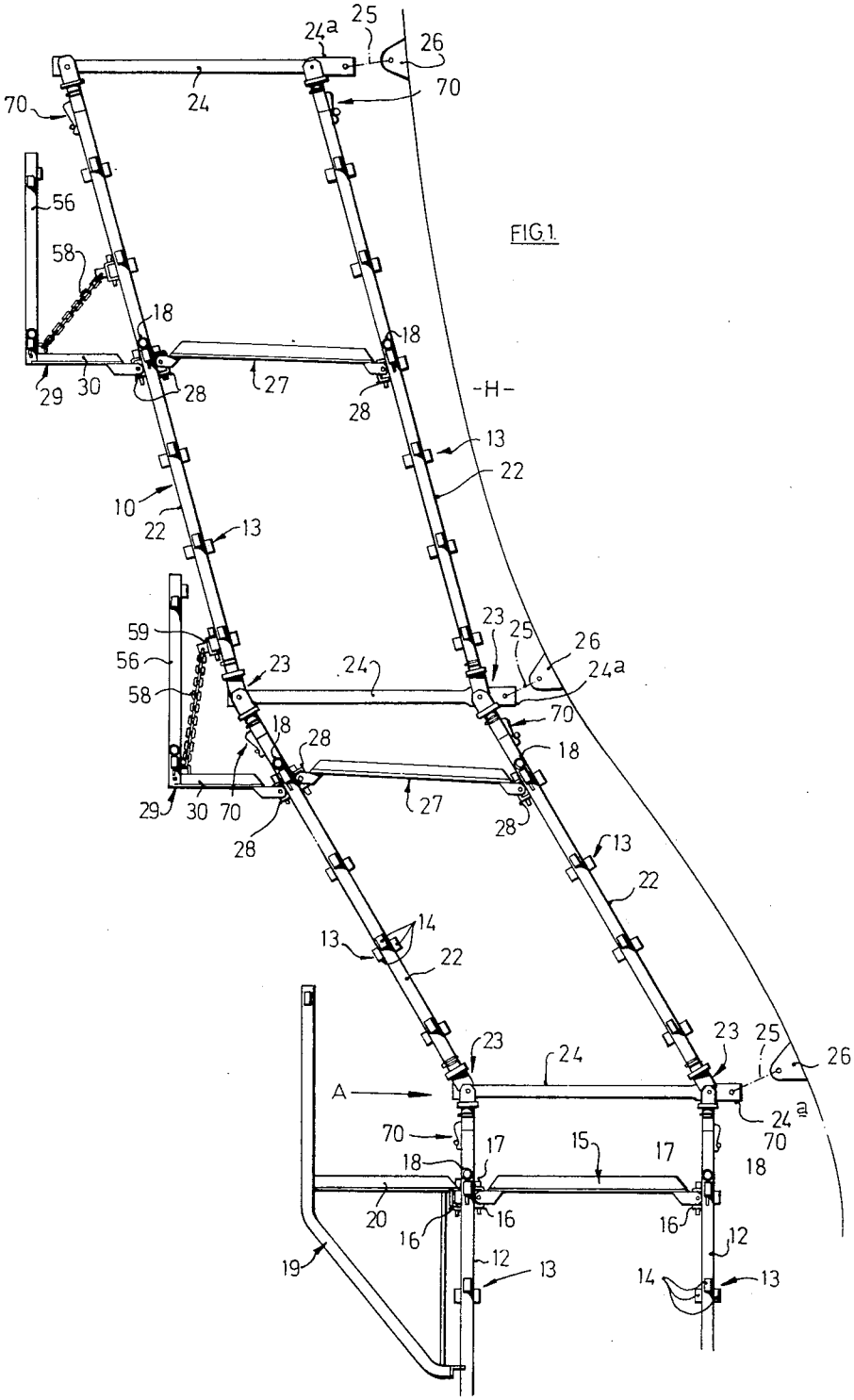

-H-
A
10
12
13
14
15
16
17
18
19
20
22
23
24
24a
25
26
27
28
29
30
56
58
59
70

SCAFFOLDING CONSTRUCTIONS

This invention concerns scaffolding structures of the type comprising a plurality of generally vertically superposed uprights arranged in horizontally spaced parallel pairs and each provided at spaced intervals along their lengths with groups of sockets by means of which the uprights are connected together by cross members each including at opposed ends thereof connecting means for firmly engaging said sockets, the cross members comprising transom elements extending between the uprights of each pair and ledger elements extending between the upright elements of adjacent pairs, whereby staging can be supported between adjacent pairs of uprights. Such scaffolding structures are hereinafter referred to as being of the kind specified.

Examples of scaffolding structures of the kind specified in which the cross members are wedgingly engaged with the sockets are disclosed in our prior British patent specification Nos. 985,912/3, 1,163,532/3, 1,180,562 and 1,278,596 and in British patent specification 1,061,929 there is described an arrangement whereby the uprights can be assembled together in vertically superposed relation to enable rigid structures to be built up to a height which is a multiple of the length of the uprights. In other known systems bolts are employed instead of wedging arrangements.

Such prior constructions are well suited for assembly in vertical structures for serving, for example, vertical walls of buildings. However, scaffolding constructions are increasingly required to serve walls which curve in a vertical plane, for example, as in ships hulls.

A type of suspended scaffolding has been developed for this purpose, wherein the scaffold construction is effectively suspended from the wall or other structure which it is to serve with the result that the uprights of such suspended scaffold construction are generally in tension. Whilst such known constructions may be collapsible or foldable, they cannot readily be made for easy dismantling in the manner of scaffolding constructions of the kind specified.

The object of the present invention is to provide a scaffolding construction of the kind specified in which the uprights, or at least some of them, are capable of being inclined relative to the vertically adjacent uprights in such a manner as to enable at least part of the weight of the construction to be transmitted downwardly through each successive upright to the ground.

According to the present invention we provide a scaffolding structure of the kind specified wherein superposed pairs of uprights are inclined relative to one another in the plane of the pairs by means of respective joint members, each such joint member comprising two pivotally connected elements one of which is adapted for abutting connection with the upper end of one of the uprights it serves to join and the other of which is adapted for abutting connection with the lower end of the other of the uprights which it serves to join, means being provided for tying the construction into an adjacent wall or other structure at least where the uprights are arranged out of the vertical.

Preferably said elements are adapted for spigot and socket type connection with the uprights. Thus, either or both of the elements may include either a spigot adapted to enter a socket afforded at the end of the upright or a socket adapted to receive a spigot afforded by or at the end of the upright.

Conveniently, the upper of the two elements of each joint includes a spigot adapted to enter an open lower end portion of the upright with which it is associated, and a plate portion which the lower end face of the upright may abut. Preferably, means are provided for positively locking the spigot within the lower end portion of the upright, for example a pin passing through aligned apertures in the spigot and in the upright.

The lower of the two elements of such joint may include a tubular spigot similarly adapted to enter the open upper end portion of the upright member with which it is associated, but preferably it includes a tubular socket part of substantially the same cross-sectional shape and dimensions as the associated upright and such socket part is disposed in abutting relation with the upright, the upright being provided with a radially expansible spigot, for example of the type described and claimed in our aforesaid British patent No. 1,061,929.

Preferably, the two such joints which serve to connect vertically adjacent pairs of uprights are both carried on a cross member which is itself adapted for tying-in to the adjacent wall or other structure which the scaffolding structure is to serve. Thus, this cross member may afford a pair of spaced pivot pins on which the elements of the joints are supported, at least one end of the cross member being adapted to receive a bolt or the like for the pivotal connection of a tie rod of adjustable length.

The cross member which carries such joints may itself also be adapted to serve as a transom element for supporting the ends of staging planks or boards.

Alternatively, the two such joints may be separate and one may either have provision for connection to an adjustable length tie rod or be connected to such a tie rod.

Alternatively, or additionally, where it is required to support staging from pairs of inclined uprights at positions intermediate the ends of the latter, there may be provided transom elements having pivotally attached at opposite ends thereof means for co-operating with the sockets of the uprights to secure the transom element between such uprights in a substantially horizontal attitude. It will be understood that the uprights of each pair are always maintained parallel to each other so that, even when the uprights are inclined to the vertical, corresponding sockets on each upright are at the same vertical height and a transom element connected between such corresponding sockets will extend substantially horizontally, the means for securing the transom elements to the uprights requiring to be pivotally connected to the transom elements only to allow for variation in the angle between the transom element and the upright as a consequence of deviation of the latter from the vertical.

The scaffolding construction in accordance with the invention is thus readily adaptable for use with walls and other surfaces which curve in a vertical plane, and is also capable of being readily dismantled into its component parts.

Figure 2:
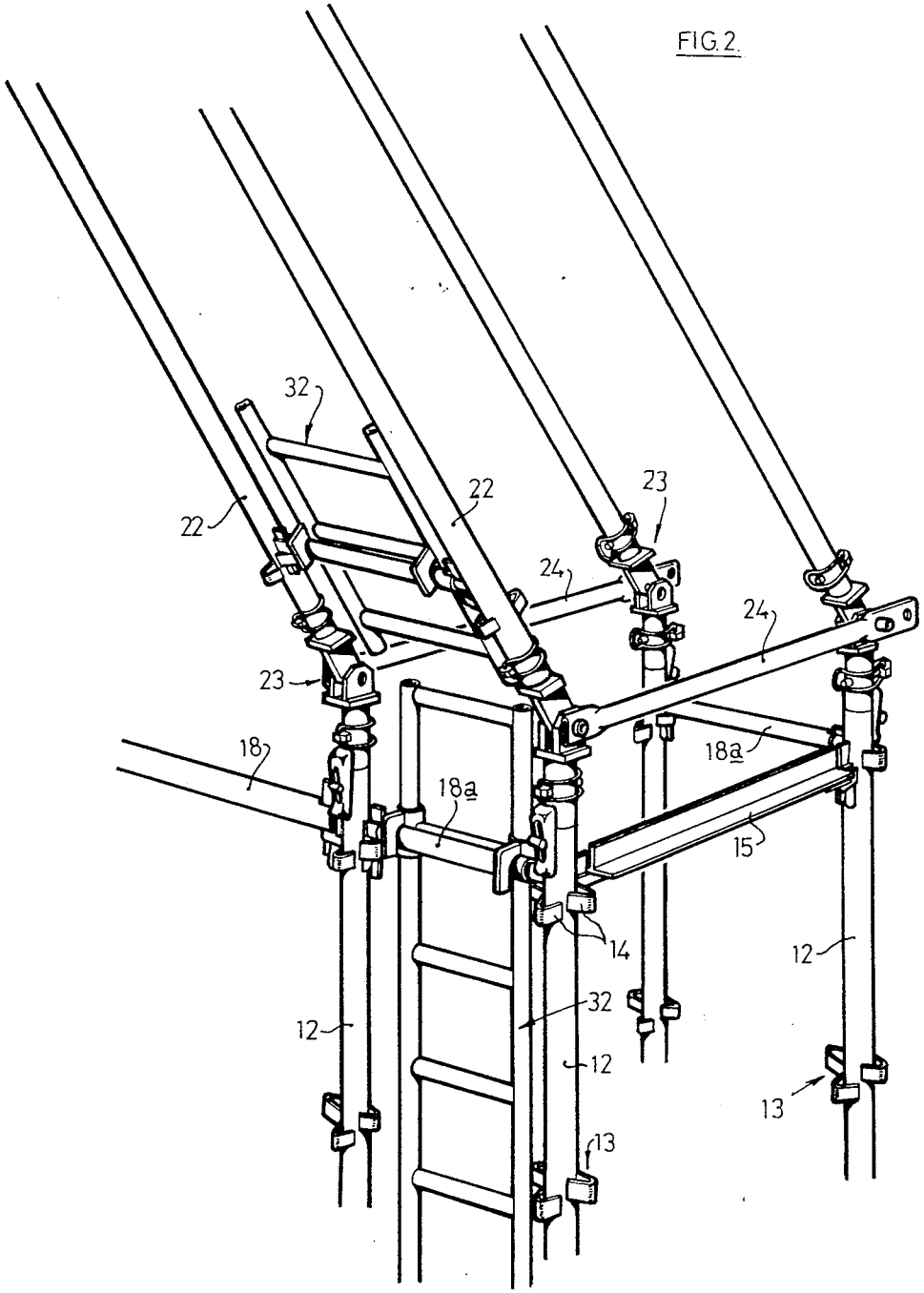
Figure 3:
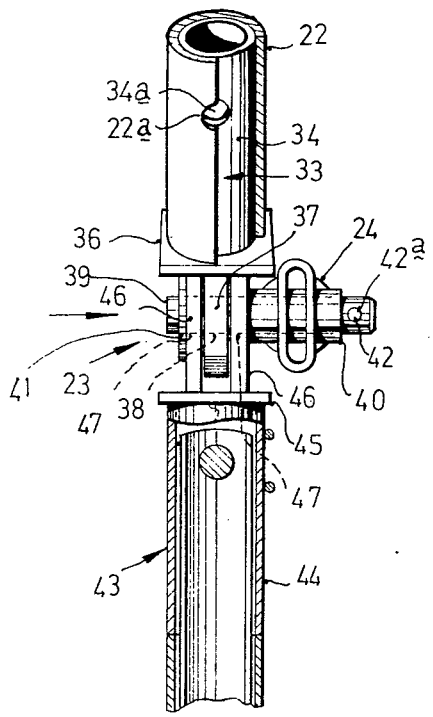
Figure 4:
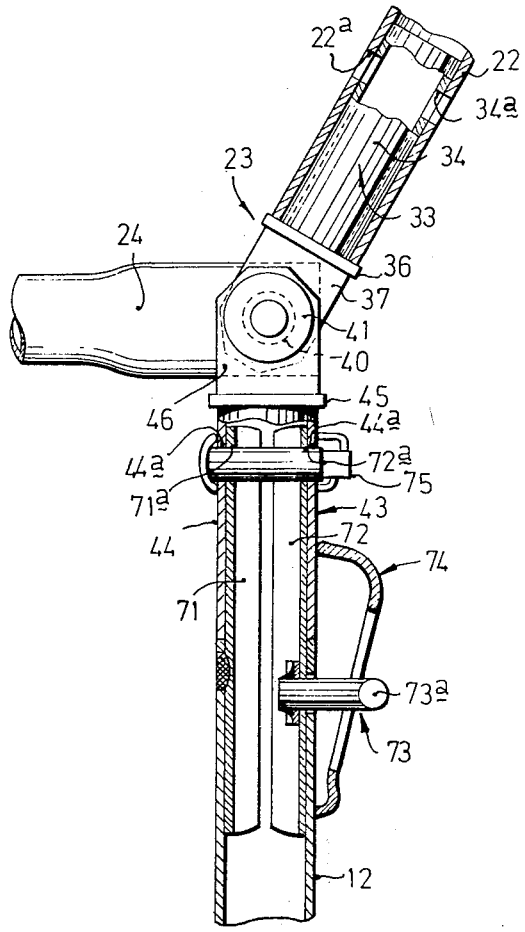
Figure 6:
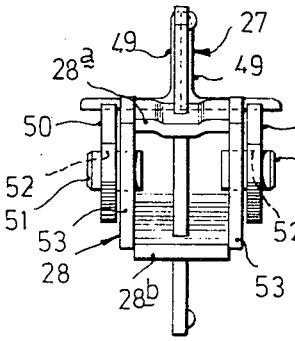
Figure 5:
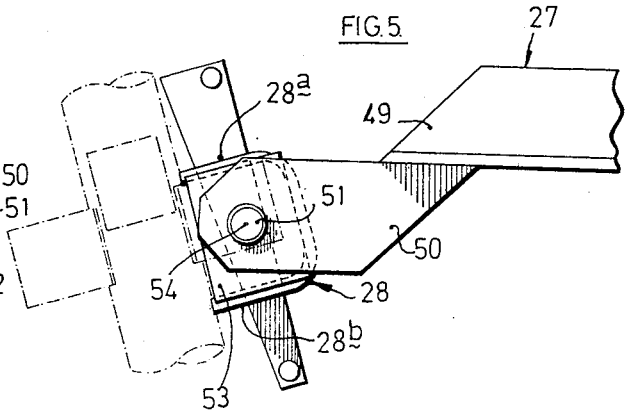
Figure 7:
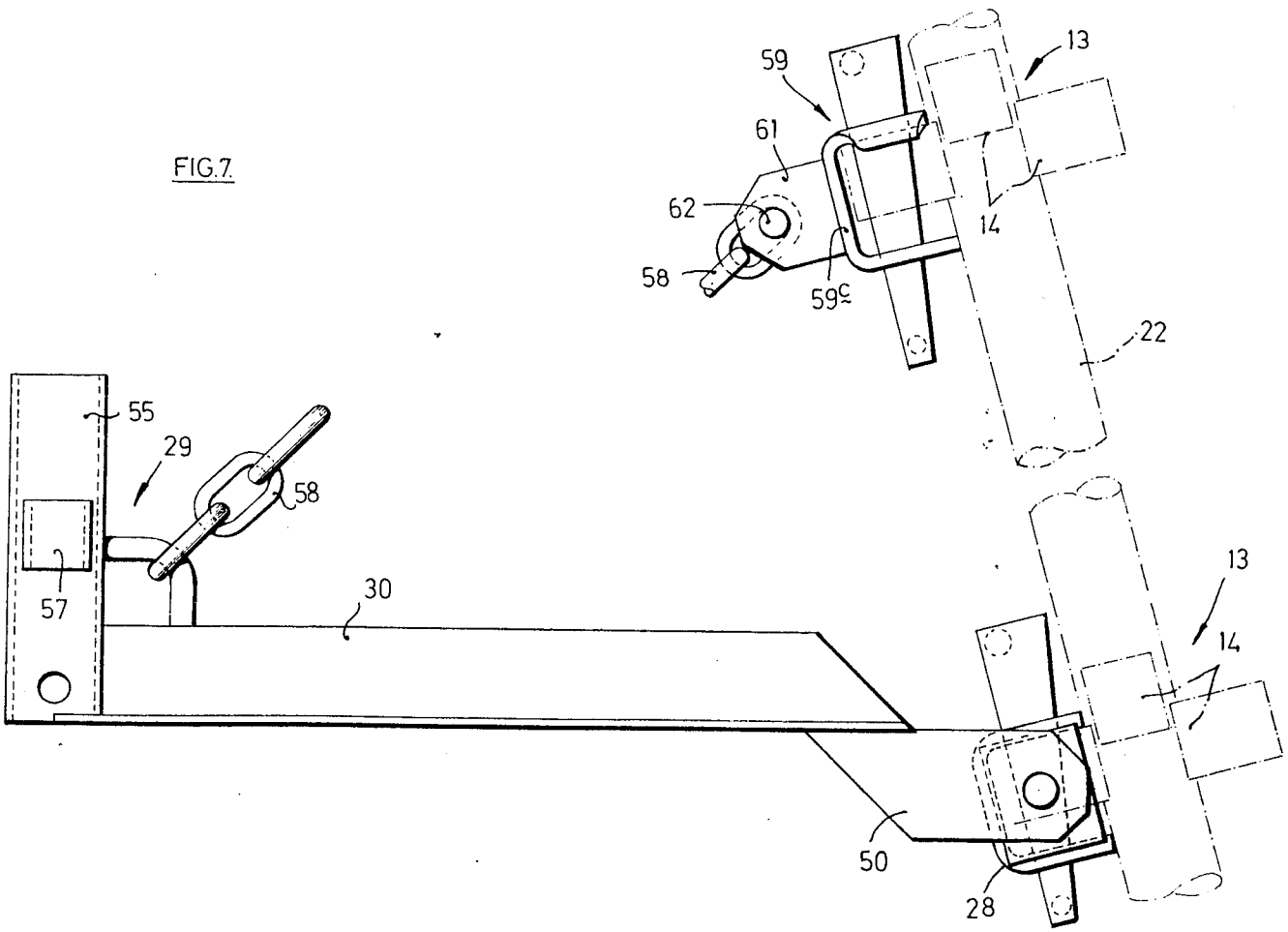
Figure 8:
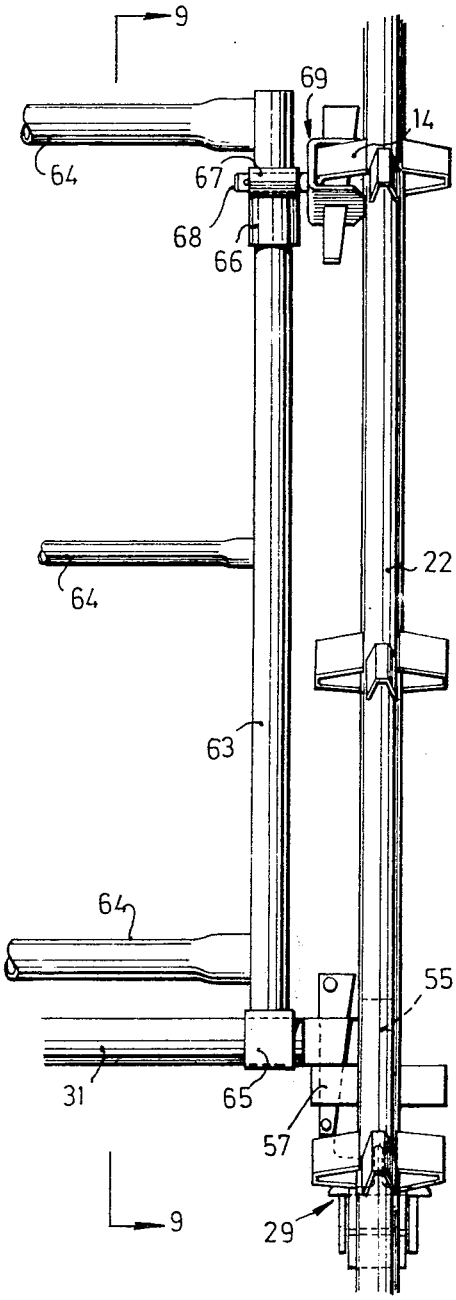
Figure 9:
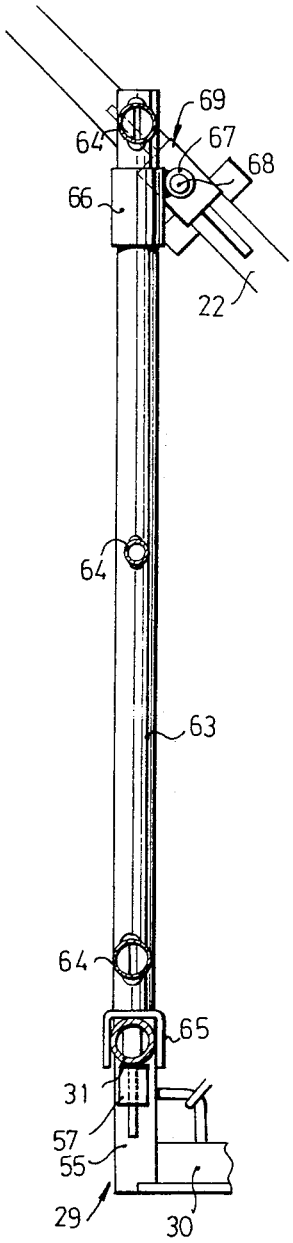
Figure 10:
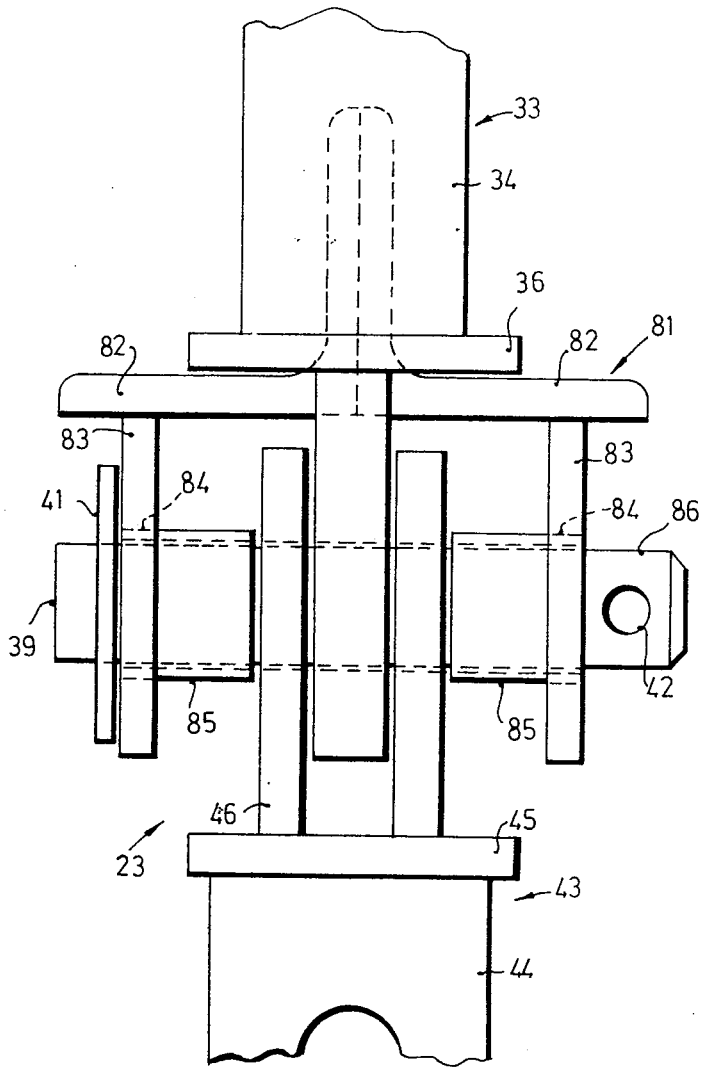

These and other features of the invention will now be described by way of example with reference to the accompanying drawings wherein:

FIG. 1 shows a scaffolding construction in accordance with the invention and in side view, FIG. 2 shows a fragmentary perspective view of an arrangement including ladder access to the platforms of the scaffolding construction of FIG. 1, FIG. 3 is an end view in the direction of arrow A of FIG. 1 showing a joint structure incorporated in the construction, FIG. 4 is a side view corresponding to FIG. 3, FIG. 5 is a side view of a pivotal transom element forming part of the construction shown in FIG. 1, FIG. 6 is an end view corresponding to FIG. 5 omitting the uprights, FIG. 7 is an end view of a staging bracket forming part of the construction shown in FIG. 1 on a larger scale, FIGS. 8 and 9 are a fragmentary side view and a sectional view of a guard barrier which may be incorporated in the construction of FIG. 1, and FIG. 10 is an end view of a joint structure showing one way in which it can be secured to the end of a transom member.

Referring firstly to FIG. 1, there is shown therein a scaffolding construction 10 adjacent to a portion of a ships hull H which is curved in a vertical plane so that the upper part substantially overhangs the lower part. The scaffolding construction 10 comprises several pairs of parallel, vertically disposed uprights 12 which are secured together in end-to-end relationship by a wedging mechanism 70 in the manner described in our aforesaid British patent specification No. 1,061,929, only the uppermost pair of such uprights 12 being shown in FIG. 1.

As indicated at 13, the uprights 12 are provided, at regular intervals along their length, with groups of sockets 14 each of which is formed as a metal pressing of substantially V-shape welded or otherwise secured to the outer surface of the upright 12 so as to define in combination therewith a vertically disposed socket which is open at its upper and lower ends.

Each pair of uprights 12 is connected together by horizontally extending transom elements 15 of inverted T-shape in section. The transom elements 15 carry fixedly at their opposite ends C-shaped brackets 16 which are adapted to embrace the sockets 14 with a wedge element 17 extending through aligned slots in the upper and lower limbs of the brackets 16 and through the socket 14 embraced by the latter so that the transom element 15 is wedgingly assembled with the upright 12. This arrangement is described in more detail in our prior British patent specification No. 1,180,562 and a similar arrangement is shown in more detail in FIGS. 5 and 6 of the accompanying drawings as hereinafter described. However, other arrangements may be adopted, for example as described in the other specifications previously mentioned.

Each such pair of uprights 12 is joined to at least one similar adjacent pair by ledger elements 18 which extend transversely of the transom elements 15 to form a rectangular frame within which staging planks may be supported between such adjacent pairs of uprights 12. Where it is required to have a working platform of greater width than the spacing between the uprights 12 of each pair, an additional staging bracket 19 can be secured to the outermost uprights 12, such bracket 19 including a transom portion 20 provided with a C-shaped bracket 16 identical with those carried by the transom elements 15.

The part of the scaffolding construction thus far described forms a rigid and stable structure which is supported on the ground and is entirely of known type.

To enable the scaffolding structure to curve outwardly to correspond to the shape of the hull H, as shown in FIG. 1, the next pair of uprights 22, which are in all respects identical with the uprights 12, are connected to the upper ends of the uprights 12 by means of swivel joints 23 which will hereinafter be described in more detail. As shown, the joints 23 are carried by a tubular cross member 24 formed with flattened end portions to which the elements of the swivel joints are pivotally connected. The inner, flattened end portion **24*a* of the tubular cross member 24 extends somewhat beyond the joint 23 carried thereby and is provided with an aperture to receive a bolt for the connection of an adjustable length tie rod indicated at 25, which at its end remote from the cross member 24 is secured in any convenient manner to an attachment lug 26 fixed to the hull H for this purpose. It will be appreciated that the attachment lug 26 can be welded in position by a workman standing on the staging afforded by the lower, rigid part of the construction. In a similar manner a further attachment lug 26 can be secured to the hull at a higher position also by a workman operating from staging carried by the lower, rigid part of the construction so that a further tubular cross member 24 can be secured to such higher lug to support the upper ends of the outwardly inclined uprights 22 through joints 23**.

In order to provide for staging between pairs of inclined uprights 22, there is provided a pivotally mounted transom element 27 which, similarly to transom element 15, is secured to corresponding sockets 14 carried by the uprights 22 by means of C-shaped brackets 28 see FIGS. 5 and 6, substantially identical to the brackets 16. But in this case the brackets 28 are pivotally associated with the transom element 27 in the manner hereinafter described.

An additional staging bracket 29 is also provied to enable the width of the staging to be increased. Like the staging bracket 19, this also includes a transom portion 30, but the latter affords a C-shaped bracket identical to the bracket 28 and which is pivotally connected in the same manner as the latter. To maintain the transom portion 30 in a horizontal attitude, the bracket is suspended by means of a chain 58 which is captively associated with the staging bracket 29 and at its free end carries a C-shaped bracket 59, similar to the brackets 16 and 28, for co-operation with any of the sockets 14. (See FIG. 7).

Referring now to FIGS. 3 and 4, each joint 23 comprises an upper element 33 comprising a tubular spigot 34 adapted to enter the open, lower end of an upright 22 and be secured thereto by means of a pin 35 (not shown) passing through aligned apertures **34*a* and 22*a* in the spigot 34 and in the upright 22. The spigot 34 is carried by an abutment plate 36 which engages the end face of the upright 22. The plate 36 is itself carried by a lug 37 having an aperture 38 through which passes a pivot pin 39 which extends through a collar 40 carried by the flattened end portion of the tubular cross member 24 on which the joint 23 is supported. The pin 39 has a washer 41 fixedly secured thereto adjacent to one end and it is formed with a transverse hole 42 adjacent to the other end for the reception of a retaining pin 42*a***.

The joint 23 further comprises a lower element 43 including a tubular portion 44 which is of the same sectional shape and dimensions as the uprights 12 (or 22) abuts the upper end of one such upright 12 (or 22). The tubular portion 44 is carried by a base plate 45 which is itself supported by a pair of spaced parallel lugs 46 formed with apertures 47 through which the pin 39 extends.

It will thus be seen that the upper and lower elements 33 and 43 of the joing 23 are capable of swivelling relative to one another about the axis of the pin 39 and that they are likewise pivotally supported by the tubular cross member 24. The cross member 24 is offset from the upper and lower elements of the joint so as not to hamper pivotal movement of such elements over the desired range of working positions.

As mentioned previously, the tubular portion 44 of the lower element 43 is secured to the upper end of an upright by means of a wedging mechanism 70 of the type described and claimed in our British patent No. 1,061,929. Briefly, this mechanism includes an expansible spigot comprising two semi-cylindrical members 71 and 72, one of which (71) is secured at the upper end of an upright 12 (or 22) internally thereof and projecting longitudinally therefrom. The other member 72 is carried by a T-head bolt 73, the head 73*a* of which is captively associated with a wedge element 74 so that when the wedge is driven downwardly the bolt 73 is pulled radially outwardly to move the one spigot member 72 away from the other member 71 and thereby expand the spigot into firm gripping relationship with the interior of both the upright 12 (or 22) and the part (in this case the tubular part 44) within which the spigot is received. The tubular part 44 and the spigot members 71 and 72 are formed with aligned holes 44*a*, 71*a*, 72*a*, for the reception of a pin 75.

Referring now to FIGS. 5 and 6, the pivotally mounted transom element 27 comprises, like the fixed (i.e. non-pivotable) transom element 15, a pair of angle section members 49 arranged back-to-back so that as a whole it is of inverted T-shape in transverse section, thereby affording ledges on which the ends of scaffolding battens may rest. At each end, the transom element 27 carries a pair of outwardly directed lugs 50 arranged in spaced parallel relationship. The C-shaped bracket 28 is pivotally mounted between the lugs 50 by means of pins 51 extending through apertures 52 in the lugs 50 and carried by side plates 53 which are secured between the upper and lower limbs 28*a* and 28*b* of the bracket 28. The latter is thus free to pivot about a transverse axis 54 to enable the upper and lower limbs 28*a* and 28*b* to embrace any selected socket 14 whilst the transom element 27 can remain substantially horizontal despite the inclination of the upright 22 on which the socket 14 is provided.

The staging bracket 29 which is shown in FIG. 7, as previously mentioned, includes a transom portion 30, and this portion is constructed in a manner similar to the transom elements 15 and 27 from two angle section members arranged back-to-back. The inner end of the transom portion is identical with the end portion of the transom element 27 as shown in FIGS. 5 and 6 so that the bracket can be connected to an inclined upright 22 by means of one of the sockets 14.

At the outer end of the transom portion 30 there is provided a tubular socket member 55 to receive the lower, reduced diameter, end portion of a handrail standard 56. The tubular socket 55 also carries a V-shape pressing 57 to define a socket similar to the sockets 14 to enable ledger elements 31 to be connected between adjacent staging brackets 29.

The transom portion 30 is maintained in a horizontal attitude by suspending the bracket from an appropriate socket 14 carried by an adjacent upright 22. For this purpose, a chain 58 is captively associated with the bracket 29 and carries at its free end a C-section bracket 59. The bracket 59 includes upper and lower limbs 59*a*, and 59*b* formed with slots for the reception of a wedge element 60 adapted to enter and extend through a socket 14 when embraced by the limbs of the bracket 59. The vertical connecting part 59*c* of the bracket carries a pair of spaced parallel lugs 61 between which extends a pin 62 which passes through the end link of the chain 58. The pin 62 may be removable so as to enable the bracket 59 to be secured to the chain at various points along the length thereof so as to alter the effective length of the chain.

A further feature of the invention concerns a guard barrier as shown in FIGS. 8 and 9. This guard barrier is intended to be used, for example, instead of handrail posts and associated handrails carried by the pivoted staging brackets 29, more particularly when the uprights 22 are inclined at a substantial angle, approaching 30°. In this case, the guard barrier rests on the ledger 31 extending between pairs of stage brackets 29 and is secured directly to an appropriate socket 14 on the upright 22 on which the staging brackets 29 are carried. The guard barrier comprises tubular end posts 63 interconnected by vertically spaced horizontal rails 64. At their lower ends, each post 63 carries a channel shaped shoe 65 so dimensioned as to engage a ledger element 18 extending between two adjacent stage brackets 29 and secured to the sockets 57 afforded thereby. Each post 63 carries slidably thereon a collar 66 to which is fixed a transversely extending bearing sleeve 67 in which is rotatable received a rod 68 which carries at one end a C-shaped bracket 69 generally similar to the bracket 59. The bracket 69 can be connected to an appropriate socket 14 on the upright 22, and because the collar 66 is slidable along the post 65 the guard barrier can be installed in this manner when the upright 22 is inclined to the vertical at any angle within a predetermined range.

Where the uprights 22 are inclined to the vertical at only a small angle, guard barriers can be fixed to the handrail posts 56 if the stage brackets 29 are employed, or alternatively they can be fixed to the uprights 22, with the shoes 65 engaging a ledger element also extending between the uprights if stage brackets are not employed.

As will be apparent from FIG. 1, it is preferred that the scaffolding construction should be tied to the adjacent structure at points corresponding to the articulation of the uprights, with a rigid tie member in the form of cross member 24 extending between the hoints 23. This minimises any tendency of the uprights 22 to bend as a result of applied forces at the points of articulation. On the other hand, as will also be apparent, the cross members 24 can represent obstacles to staging supported by the pivoted transom elements 27 if the latter are disposed near the upper ends of the uprights 22. It is contemplated that, to overcome this difficulty, it may in some cases be possible to eliminate the cross member 24 under such circumstances and tie-in the scaffolding construction to the adjacent structure at some point intermediate the ends of the uprights 22, for example at a position corresponding to the transom element 27. This could be achieved by extending outwardly one or both of the pins 51 whereby the C-shape brackets 28 are pivotally mounted on the transom element 27 and pivotally supporting a suitable adjustable tie on one or both of such extended pins. In which case, the joints 23 would be constructed in the same manner as previously described, but with the use of a reduced length pin securing the two elements of the joint only to one another.

Alternatively, the cross members 24 may themselves be formed to serve as transom elements by being formed over at least the main portion of their lengths by two angle section members joined back-to-back. One such arrangement is illustrated in FIG. 10. In this case the cross member 24 which carries two of the joints 23 is replaced by a transom element 81 comprising two angle section members 82 arranged back-to-back in a manner similar to those of the transom element 27. Outwardly directed lugs 83, similar to the lugs 50 are provided but instead of supporting a pivotally mounted C-shape bracket such as 28 they support one of the joints 23. For this purpose each lug 50 is formed with an aperture 84 in which is received and secured one end of a respective collar 85 which projects laterally inwardly as seen in FIG. 10. The two collars 84 support between them the pin 39 of the joint 23. The joint itself is exactly as previously described in relation to FIGS. 3 and 4.

To enable the transom element 81 to be tied-in to the hull H at one end, the lugs 83 at that end may be laterally extended and support a further pin outwardly of the pin 39 whereby any suitable form of adjustable tie may be carried by such further pin.

It would be appropriate for the upper elements 33 of the joints 23 carried by the transom element 81 to be provided with sockers similar to the sockets 57 of the staging brackets 29 for the reception of ledger elements.

Access ladders may be incorporated into the scaffolding construction as shown in FIG. 2 by having two adjacent pairs of uprights 22 or (12) spaced apart by a distance sufficient only to accommodate the width of a ladder, such adjacent uprights being connected together by ledger elements 18*a* of correspondingly short length to which ladder sections 32 are attached in any convenient manner. Alternatively, the ladder sections may be constructed in such a manner as to be capable of being secured directly to such adjacent uprights instead of the short length ledger elements just mentioned, or the stiles of the ladder may be constituted by scaffold uprights, similar to the uprights 22, integrally joined by means of the rungs.

Although the scaffolding construction in accordance with the invention can conveniently be assembled as a free standing construction resting on the ground with the upper, inclined sections thereof tied-in to the adjacent structure, it is also possible for the construction to be used as suspended scaffolding, providing the uprights are positively connected to the joint elements, for example by means of pins extending through the aligned apertures provided in the latter and in the uprights. In this case, the uppermost cross member can be incorporated into an appropriate frame structure which can be supported from the structure to be served by the scaffolding in any known manner, with the scaffolding construction itself suspended from such frame structure.

Whether used as a free standing construction, or suspended, the scaffolding construction of the present invention can readily be assembled from its modular component parts and therefore can be constructed to suit individual applications so as to provide a degree of flexibility in use which cannot be achieved by known suspended scaffolding constructions. For example, in such known constructions staging can only be provided at one level in each articulated section and the height of such sections is invariable. However, with the present invention staging can be arranged at any of a number of levels in each section, and the height of each section can be varied by selecting uprights of differing lengths. Moreover, by omitting the joints, certain sections of the construction can be rigidly assembled with one another in conventional manner, thereby enabling the structure to be built from the ground upwards and allowing at least part of the weight of the construction to be transmitted to the ground.

It is particularly to be noted that the construction herein described can be used as either a truly suspended scaffolding with no part of it resting on the ground or as a ground supported structure, because the form of joint described is capable of transmitting load in compression and in tension.

When suspended, the scaffolding can be built up stage-by-stage by raising the assembled structure periodically. The reverse is also true, and the scaffolding can be fully dismantled, one stage at a time by progressively lowering the structure. The simple connections between the uprights greatly facilitate this and the use of pins to secure the uprights to the joints renders the dismantling operation very simple.

Compared with known types of suspended scaffolding, the ground stage space needed for the components is much reduced because the scaffolding of this invention can be fully dismantled.

It is also to be noted that if individual stages of the inclined structure are diagonally braced in a vertical plane it is then not necessary to tie the scaffolding into an adjacent structure at every joint level.

I claim:

1. In a scaffolding structure comprising:- a. a plurality of generally vertically superposed uprights arranged in horizontally spaced parallel pairs and each provided at spaced intervals along their lengths with groups of sockets, and b. cross members each including at opposed ends thereof connecting means firmly engaging selected ones of said sockets, the cross members comprising firstly transom elements extending between the uprights of each pair and secondly ledger elements extending between the uprights of adjacent pairs, whereby staging can be supported between adjacent pairs of said uprights, the improvement comprising c. joint means for connecting said uprights together in superposed relation in a vertical plane with said superposed uprights in inclined relation to one another in said plane, and d. means for tying the structure into an adjacent wall or other structure at least where the uprights are arranged out of the vertical.

2. Joint means as claimed in claim 1 comprising two pivotally connected elements one of which is adapted for abutting connection with the upper end of one of the uprights it serves to join and the other of which is adapted for abutting connection with the lower end of the other of the uprights which it serves to join.

3. Joint means as claimed in claim 1 wherein said elements are adapted for spigot and socket type connection with the uprights.

4. Joint means as claimed in claim 3 wherein the upper of the two elements of each joint includes a spigot adapted to enter an open lower end portion of the upright with which it is associated, and a plate portion which the lower end face of the upright abuts.

5. Joint means as claimed in claim 2 wherein the lower of the two elements of each joint includes a tubular socket part of substantially the same cross-sectional shape and dimensions as the associated upright and such socket part is disposed in abutting relation with the upright, the latter being provided with a radially expansible spigot which enters said socket part.

6. Joint means as claimed in claim 2 wherein means are provided for positively locking the spigot and socket connections of the joint.

7. Joint means a claimed in claim 1 wherein two of said joints are both carried on a cross member.

8. Joint means as claimed in claim 7 wherein said cross member itself affords said means for tying-in to the adjacent wall or other structure which the scaffolding structure is to serve.

9. Joint means as claimed in claim 7 wherein said cross member carries a pair of spaced pivot pins on which the elements of the respective joints are supported.

10. Joint means as claimed in claim 7 wherein said cross member is also adapted to serve as a transom element for supporting the ends of staging planks or boards.

11. A scaffolding structure including joint means as claimed in claim 1 wherein transom elements are provided to support staging from pairs of inclined uprights at positions intermediate the ends of the latter, such transom elements having pivotally attached at opposite ends thereof means for co-operating with the sockets of the uprights to secure the transom elements between such uprights in a substantially horizontal attitude.

12. A scaffolding structure including joint means as claimed in claim 1 including stage brackets each attached to an inclined upright, each such stage bracket including a transom portion adapted to support the ends of staging planks or boards and having pivotally attached at one end thereof means for co-operating with a selected one of the sockets of the upright to secure the transom element to such an upright in a substantially horizontal attitude, the transom portion being further supported by means of a suspension element attached to means for co-operating with a further selected one of the sockets of the upright.

13. A scaffolding structure including joint means as claimed in claim 1 wherein a guard barrier is provided, the guard barrier including horizontal rails and upright end posts which latter are provide at their lower ends with means for engaging one of the ledger elements and which end posts further carry slidably thereon a collar on which is mounted connecting means for engaging a selected one of the sockets of the adjacent upright.

14. A scaffolding structure according to claim 1 wherein each joint member is adapted to transmit both compressive and tensile loads whereby the structure may either rest upon the ground or be suspended.

* * * * *